US006213480B1

(12) United States Patent
Rodriguez

(10) Patent No.: US 6,213,480 B1
(45) Date of Patent: Apr. 10, 2001

(54) ROLLER WHEEL SLIDER

(76) Inventor: Juan Carlos Rodriguez, 12 Avalon Ave., #2, San Francisco, CA (US) 94112

( * ) Notice: Subject to any disclaimer, the term of this patent is extended or adjusted under 35 U.S.C. 154(b) by 0 days.

(21) Appl. No.: 09/343,314

(22) Filed: Jun. 30, 1999

(51) Int. Cl.[7] ..... A63C 17/04

(52) U.S. Cl. ..... 280/11.204; 280/11.3

(58) Field of Search ..... 280/841, 843, 280/11.19, 11.204, 11.207, 11.208, 11.221, 11.222, 111.223, 11.226, 11.227, 11.3, 809; 301/5.3, 5.7

(56) References Cited

U.S. PATENT DOCUMENTS

| | | | | |
|---|---|---|---|---|
| 2,826,830 | * | 3/1958 | Nelson | 280/11.3 |
| 2,944,827 | * | 7/1960 | Makara | 280/11.227 |
| 3,306,623 | * | 2/1967 | Weitzner | 280/843 |
| 3,512,796 | * | 5/1970 | Mangus | 280/11.227 |
| 3,522,951 | * | 8/1970 | Tyson | 280/843 |
| 3,526,976 | * | 9/1970 | Jacobs | 280/11.3 |
| 3,963,251 | * | 6/1976 | Miano | 280/843 |
| 4,412,685 | * | 11/1983 | Szamek | 280/11.19 |
| 4,691,453 | * | 9/1987 | Tifre | 36/8.3 |
| 5,249,376 | * | 10/1993 | Capria | 36/115 |
| 5,312,165 | * | 5/1994 | Spletter | 301/5.23 |
| 5,549,331 | * | 8/1996 | Yun et al. | 280/11.22 |
| 5,590,890 | * | 1/1997 | Rosso et al. | 280/11.22 |
| 5,601,299 | * | 2/1997 | Yun et al. | 280/87.042 |
| 5,716,074 | * | 2/1998 | Theodorou | 280/843 |

FOREIGN PATENT DOCUMENTS

| | | | | |
|---|---|---|---|---|
| 84073 | * | 2/1920 | (CH) | 280/11.19 |
| 309567 | * | 10/1918 | (DE) | 280/841 |
| 456796 | * | 3/1928 | (DE) | 280/843 |
| 416858 | * | 10/1910 | (FR) | 280/843 |
| 404008382 | * | 1/1992 | (JP) | 280/11.19 |

* cited by examiner

*Primary Examiner*—Brian L. Johnson
*Assistant Examiner*—Bridget Avery
(74) *Attorney, Agent, or Firm*—Jack Lo

(57) ABSTRACT

A roller wheel slider includes a mounting plate with clamps on opposite sides for clamping to a shoe. The mounting plate includes a front roller wheel support plate connected to a rear roller wheel support plate by a connecting member. A plurality of axles are mounted transversely under each roller wheel support plate, and a plurality of roller wheels are mounted to each axle. A hard plate on the front end of the mounting plate allows the user to slide when the rear of the shoe is lifted. A resilient friction pad on the rear end of the mounting plate allows the user to brake when the front of the shoe is lifted. The roller wheels are preferably only about 0.5 inch (1.2 cm) in diameter, so that they raise the user by an almost imperceptible amount from the ground to provide a sense of safety, and a sense of sliding along the ground. The large number of roller wheels are distributed across a wide area under the shoe to share the load for durability.

10 Claims, 2 Drawing Sheets

ROLLER WHEEL SLIDER

BACKGROUND OF THE INVENTION

1. Field of the Invention

This invention relates generally to roller skates and roller blades.

2. Prior Art

Roller skates and roller blades are boots with wheels. A roller skate has four wheels on two axles, and a roller blade has four wheels in a straight line on four axles. Roller skates have 5 cm wheels, and roller blades have 8 cm wheels. Such large wheels lift the users noticeably off the ground and provide sensations which are very different from normal shoes. Novice users are not used to wearing very tall shoes, so they feel unstable and unsafe. This sense of fear discourages many people from trying roller skating or roller blading.

OBJECTS OF THE INVENTION

Accordingly, objects of the present roller wheel slider are:

to enable a user to roll along the ground for recreation;
to add very little height to the user for improved stability;
to be low enough to the ground to give a sense of sliding along the ground;
to provide a sense of safety;
to provide braking capability; and
to be attachable to any shoe.

Further objects of the present invention will become apparent from a consideration of the drawings and ensuing description.

BRIEF SUMMARY OF THE INVENTION

A roller wheel slider is comprised of a mounting plate with clamps on opposite sides for clamping to a shoe. The mounting plate includes a front roller wheel support plate connected to a rear roller wheel support plate by a connecting member. A plurality of axles are mounted transversely under each roller wheel support plate, and a plurality of roller wheels are mounted to each axle. A hard plate on the front end of the mounting plate allows the user to slide when the rear of the shoe is lifted. A resilient friction pad on the rear end of the mounting plate allows the user to brake when the front of the shoe is lifted. The roller wheels are preferably only about 0.5 inch (1.2 cm) in diameter, so that they raise the user by an almost imperceptible amount from the ground to provide a sense of safety, and a sense of sliding along the ground. The large number of roller wheels are distributed across a wide area under the shoe to share the load for durability.

Figure 1:
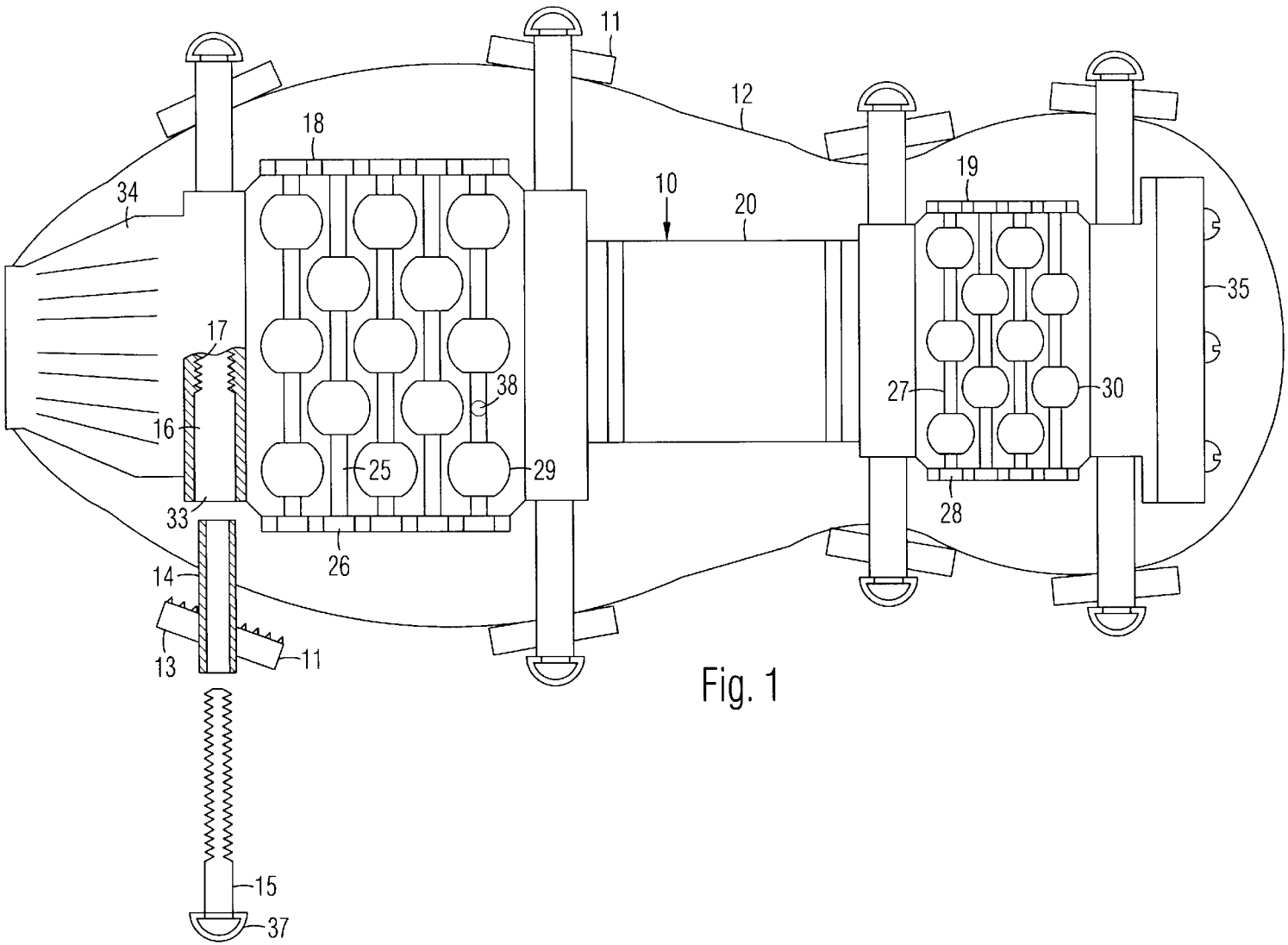
FIG. 1 is a bottom view of the present roller wheel slider attached to a shoe.

| DRAWING REFERENCE NUMERALS | |
|---|---|
| 10. Mounting Plate | 11. Clamps |
| 12. Shoe | 13. Gripping Member |
| 14. Tube | 15. Thumb Screw |
| 16. Smooth Outer Section | 17. Threaded Middle Section |
| 18. Front Roller wheel Support Plate | 19. Rear Roller wheel Support Plate |
| 20. Connecting Member | |
| 22. Keyed Socket | 21. Keyed Socket |
| 24. Keyed End | 23. Key End |
| 26. Brackets | 25. Axles |
| 28. Brackets | 27. Axles |
| 30. Roller wheels | 29. Roller wheels |
| 32. Star-Shaped Channel | 31. Bearings |
| 34. Hard Plate | 33. Transverse Channels |
| 36. Spikes | 35. Resilient Pad |
| 38. Vertical Support | 37. Hinged Head |

DETAILED DESCRIPTION OF THE INVENTION

Figure 2:
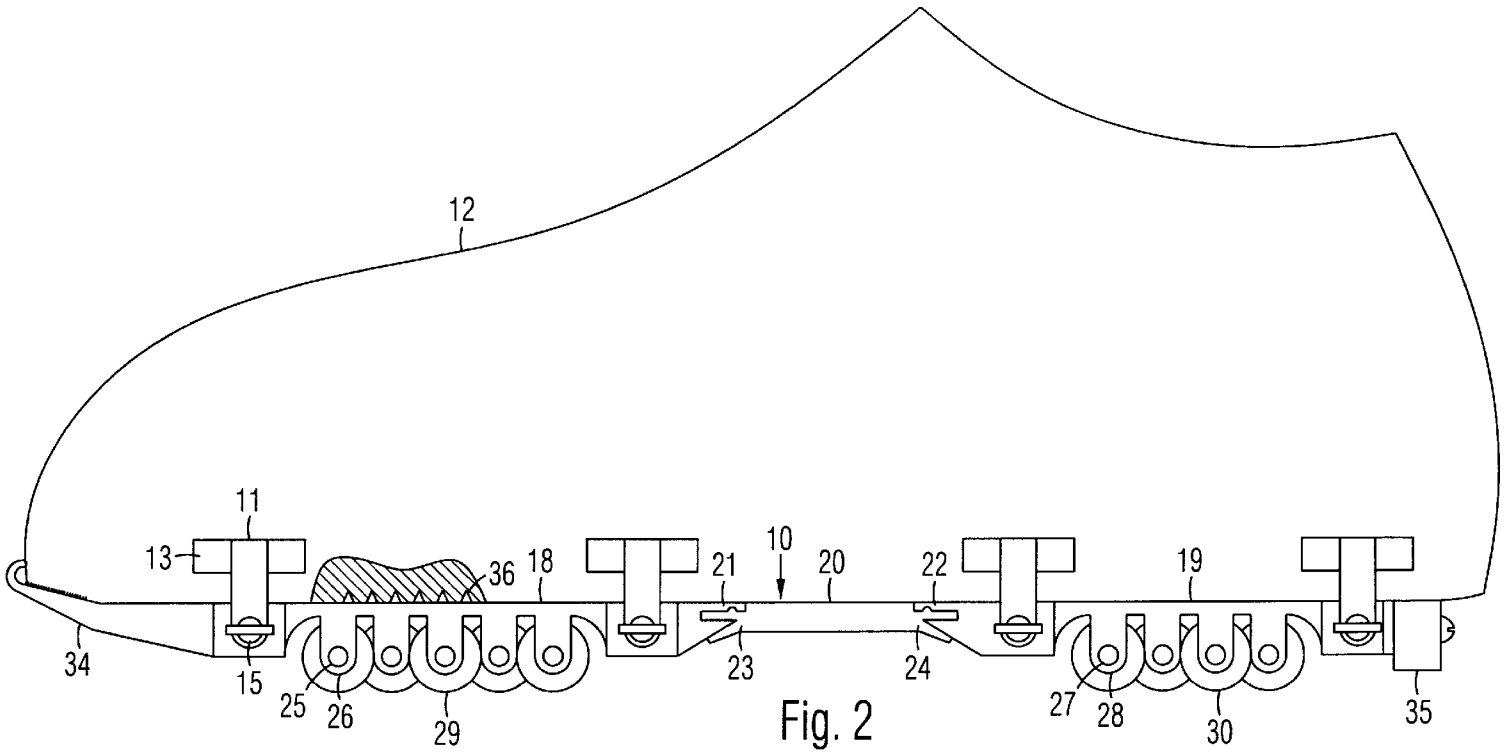
FIG. 2 is a side view of the roller wheel slider attached to the shoe.

A preferred embodiment of the roller wheel slider is shown in a bottom view in FIG. 1 and a side view in FIG. 2. It is comprised of a mounting plate 10 with clamps 11 on opposite sides for clamping to a shoe 12. Each clamp 11 is comprised of a gripping member 13 attached to a tube 14, and a fastener or thumb screw 15. Each thumb screw 15 includes a hinged head 37 which is pivoted to an orthogonal position after tightening to prevent it from protruding. A plurality of transverse channels 33 are arranged along mounting plate 10. Each transverse channel 33 is comprised of smooth outer sections 16 and a threaded middle section 17. Tubes 14 of clamps 11 are positioned in smoother outer sections 16 of channels 33, and slidably adjusted for clamping onto shoe 12, which may be of any size. Thumb screw 15 is inserted through tube 14, screwed into threaded middle section 17, and tightened. Alternatively, mounting plate 10 may be integrally attached to shoe 12. Mounting plate 10 includes a front roller wheel support plate 18connected to a rear roller wheel support plate 19 by a connecting member 20. In FIG. 2, key sockets 21 and 22 at the inner ends of support plates 18 and 19 detachably mate with keyed opposite ends 23 and 24 on connecting member 20. Connecting members of different lengths may be used for mounting to different size shoes.

A plurality of first axles 25 are mounted transversely under roller wheel support plate 18 by brackets 26, and a plurality of second axles 27 are mounted transversely under roller wheel support plate 19 by brackets 28. A plurality of first roller wheels 29 are mounted on each axle 25, and a plurality of second roller wheels 30 are mounted on each axle 27. Axles 25 and 27 are supported between roller wheels 29 and 30 by vertical supports 38 (only one shown). A plurality of small spikes 36 are arranged on top of mounting plate 10 to provide a non-slip surface.

Figure 4:
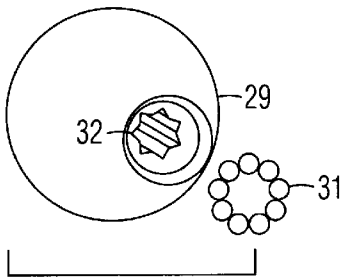
FIG. 4 is an exploded view of the roller wheel.
Figure 3:
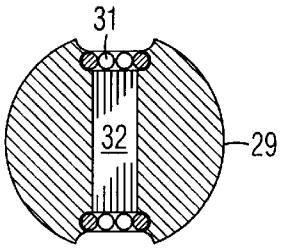
FIG. 3 is a sectional view of a roller wheel, taken along line 3—3 in FIG. 2.

A roller wheel 29 is shown in a sectional view in FIG. 3 and an exploded view in FIG. 4. Low-friction "TEFLON" bearings 31 are arranged around opposite ends of a star-shaped channel 32 extending through roller wheel 29. Contact between channel 32 and the axle (not shown) is minimized by the star shape of the channel. Roller wheels 30 are internally identical to roller wheels 29. Referring back to FIGS. 1 and 2, a hard plate 34 is provided on the front end of mounting plate 10 to allow the user to slide when the rear of the slider is lifted. A resilient friction pad 35 is mounted to the rear end of mounting plate 10 to allow the user to brake when the front end of the slider is lifted.

Roller wheels 29 and 30 are each preferably only about 0.5 inch (1.2 cm) in diameter, so that they raise the user by an almost imperceptible amount from the ground to provide a sense of safety, and a sense of sliding along the ground. The diameter may be varied, as along as they are much smaller than roller skate or roller blade wheels. Such a small diameter necessitates a large number of roller wheels distributed over a wide area under shoe 12 to share the load for durability. The roller wheels preferably total more than eight, although greater numbers may be used.

SUMMARY AND SCOPE

Accordingly, the roller wheel slider enables a user to roll along the ground for recreation. It adds very little height to the user for improved stability. It is low enough to the ground to give a sense of sliding along the ground. It is low enough to provide a sense of safety. It provides braking capability. It is also attachable to any shoe.

Although the above description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

I claim:

1. A roller wheel slider, comprising:

a mounting plate for mounting to a shoe, said mounting plate including a plurality of transverse channels each with smooth outer sections and a threaded inner section;

a plurality of clamps inserted into corresponding ones of said channels for clamping to opposite sides of said shoe, each of said clamps comprising a gripping member connected to a tube. slidably positioned in a corresponding one of said smooth outer sections, and a thumb screw extending through said tube and mating with said threaded inner section, said tube being slidable in a corresponding one of said channels for adjusting to said shoe;

a front roller wheel support plate on a front portion of said mounting plate;

a connecting member with one end detachably connected to a rear of said front roller wheel support plate;

a rear roller wheel support plate on a rear portion of said mounting plate, said rear roller wheel support plate detachably connected to a rear of said connecting member;

a plurality of axles mounted transversely under said front roller wheel support plate and said rear roller wheel support plate; and a plurality of roller balls mounted to each of said axles.

2. The roller wheel slider of claim 1, further including a resilient friction pad at a rear end of said mounting plate for allowing said user to brake when a front of said shoe is lifted.

3. The roller wheel slider of claim 1, further including a star-shaped channel in each of said roller balls, and a plurality of bearings arranged at opposite ends of said star-shaped channel, said star-shaped channel being shaped to minimize contact with a corresponding one of said axles.

4. The roller wheel slider of claim 1, further including a plurality of spikes on top of said mounting plate for gripping said shoe.

5. The roller wheel slider of claim 1, further including a hard plate under said front portion of said mounting plate for enabling said user to slide when a rear of said shoe is lifted.

6. A roller wheel slider, comprising:

a mounting plate for mounting to a shoe, said mounting plate including a plurality of transverse channels each with smooth outer sections and a threaded inner section;

a front roller wheel support plate on a front portion of said mounting plate;

a connecting member with one end detachably connected to a rear of said front roller wheel support plate;

a rear roller wheel support plate on a rear portion of said mounting plate, said rear roller wheel support plate detachably connected to a rear of said connecting member;

a plurality of clamps inserted into corresponding ones of said channels for clamping to opposite sides of said shoe, each of said clamps comprising a gripping member connected to a tube slidably positioned in a corresponding one of said smooth outer sections, and a thumb screw extending through said tube and mating with said threaded inner section, said tube being slidable in a corresponding one of said channels for adjusting to said shoe;

a plurality of first axles connected to said front roller wheel support plate;

a plurality of second axles connected to said rear roller wheel support plate;

a plurality of first roller balls mounted on each of said first axles, said first roller balls being at most about 0.5 inch in diameter; and a plurality of second roller balls mounted on each of said second axles; said second roller balls being at most about 0.5 inch in diameter;

wherein said first roller balls and said second roller balls totaling at least eight for sharing the weight of said user.

7. The roller wheel slider of claim 6, further including a resilient friction pad at a rear end of said mounting plate for allowing said user to brake when a front of said shoe is lifted.

8. The roller wheel slider of claim 6, further including a star-shaped channel in each of said roller balls, and a plurality of bearings arranged at opposite ends of said star-shaped channel, said star-shaped channel being shaped to minimize contact with a corresponding one of said axles.

9. The roller wheel slider of claim 6, further including a plurality of spikes on top of said mounting plate for gripping said shoe.

10. The roller wheel slider of claim 6, further including a hard plate under a front portion of said mounting plate for enabling said user to slide when a rear of said shoe is lifted.

* * * * *